US005657987A

United States Patent [19]

Pfutzenreuter

[11] Patent Number: 5,657,987

[45] Date of Patent: Aug. 19, 1997

[54] PINBALL SOLENOID POWER CONTROL SYSTEM

[75] Inventor: William Clark Pfutzenreuter, Arlington Heights, Ill.

[73] Assignee: Capcom Coin-Op, Inc., Arlington Heights, Ill.

[21] Appl. No.: 528,743

[22] Filed: Sep. 15, 1995

[51] Int. Cl.[6] ..... A63F 2/30

[52] U.S. Cl. ..... 273/119 A; 273/121 A

[58] Field of Search ..... 273/118, 119, 273/121; 363/18, 19, 20, 21; 361/152, 154

[56] References Cited

U.S. PATENT DOCUMENTS

| | | | |
|---|---|---|---|
| 4,093,232 | 6/1978 | Nutting et al. . | |
| 4,198,051 | 4/1980 | Bracha et al. . | |
| 4,203,602 | 5/1980 | Kral . | |
| 4,209,826 | 6/1980 | Priegnitz | 363/21 |
| 4,234,903 | 11/1980 | Harper . | |
| 4,272,649 | 6/1981 | Pfeiffer | 273/121 A X |
| 4,293,888 | 10/1981 | McCarty . | |
| 4,363,485 | 12/1982 | Edwall | 273/121 A |
| 4,384,716 | 5/1983 | Powers . | |
| 4,399,483 | 8/1983 | Phelan . | |
| 4,511,945 | 4/1985 | Nielsen . | |
| 4,546,403 | 10/1985 | Nielsen . | |
| 4,599,674 | 7/1986 | Ishikawa et al. . | |
| 4,634,126 | 1/1987 | Kimura . | |
| 4,825,332 | 4/1989 | Aoki . | |
| 4,895,369 | 1/1990 | Degar . | |
| 5,074,558 | 12/1991 | Bleich et al. | 273/121 A |
| 5,091,677 | 2/1992 | Bleich et al. . | |
| 5,092,597 | 3/1992 | Kaminkow et al. . | |
| 5,146,388 | 9/1992 | Parker . | |
| 5,149,094 | 9/1992 | Tastad . | |
| 5,170,345 | 12/1992 | Poole | 273/121 A |
| 5,284,342 | 2/1994 | Tanzer et al. | 273/121 A |
| 5,297,793 | 3/1994 | DeMar . | |
| 5,322,282 | 6/1994 | Lund . | |
| 5,539,608 | 7/1996 | Hurley et al. | 361/152 |

FOREIGN PATENT DOCUMENTS

| | | |
|---|---|---|
| 0068006 | 4/1982 | Japan . |
| 06304301 | 11/1994 | Japan . |

OTHER PUBLICATIONS

IBM Technical Disclosure Bulletin "Pulse Width Modulation of Magnets", Wells, vol. 21, No. 3, Aug. 18.

Design News, "The uP Says Tilt–Pinball Machines Grow Smarter", vol. 23, No. 1, pp. 16–18 Jan. 1978.

*Primary Examiner*—Raleigh W. Chiu

*Attorney, Agent, or Firm*—Gary Jarosik

[57] ABSTRACT

A pinball machine is provided and generally includes a power supply for supplying unfiltered, unregulated DC voltage, a solenoid for activating a play feature device such as a flipper, a microprocessor for controlling game play activities, a clock associated with the microprocessor for supplying a first interrupt signal thereto, a memory device associated with the microprocessor having stored therein a plurality of duty cycle settings, each of the duty cycle settings comprising a predetermined pattern of ON and OFF states, a voltage detection circuit linked to the microprocessor and connected to the power supply for providing to the microprocessor a voltage value indicative of the level of the DC voltage, wherein the microprocessor utilizes the voltage value to select one of the plurality of duty cycle settings, and a driver, responsive to the microprocessor, connecting the power supply to the solenoid for controlling the flow of current thereto based upon a corresponding one of the states of the predetermined pattern of the select one of the plurality of duty cycle settings as determined by the first interrupt signal. Preferably, a zero-voltage detect circuit is also provided and used to detect when the DC voltage level approaches zero for signalling the microprocessor to reset or synchronize the clock.

17 Claims, 5 Drawing Sheets

| LINE VOLTAGE | | | | | |
|---|---|---|---|---|---|
| NOMINAL VOLTAGE | >+9% | >+3% | 3% | <-9% | <-15% |
| DUTY CYCLE | 75% | 81% | 87% | 94% | 100% |
| INTERRUPT COUNT 0 | ON | ON | ON | OFF | ON |
| 1 | ON | ON | ON | ON | ON |
| 2 | ON | ON | ON | ON | ON |
| 3 | OFF | OFF | OFF | ON | ON |
| 4 | ON | ON | ON | ON | ON |
| 5 | ON | ON | ON | ON | ON |
| 6 | ON | ON | ON | ON | ON |
| 7 | OFF | ON | ON | ON | ON |
| 8 | ON | OFF | ON | ON | ON |
| 9 | ON | ON | ON | ON | ON |
| 10 | ON | ON | OFF | ON | ON |
| 11 | OFF | ON | ON | ON | ON |
| 12 | ON | ON | ON | ON | ON |
| 13 | ON | OFF | ON | ON | ON |
| 14 | ON | ON | ON | ON | ON |
| 15 | ON | ON | ON | ON | ON |

PINBALL SOLENOID POWER CONTROL SYSTEM

BACKGROUND OF THE INVENTION

This invention relates generally to a system for controlling power to a play feature utilized in coin operated games and, more particularly, relates to a system for adjusting the average amount of current supplied to a solenoid used to move a play feature in a pinball game in response to variations in line voltages for the purpose of attaining uniformity of movement.

Currently, pinball machines utilize unregulated power supplies to minimize costs where the DC output of these power supplies are dependent upon the AC line voltage to which the machine is "plugged into." Unfortunately, it is known that line voltages from municipal supplies may vary by as much as 15% from the specified or nominal voltage which variations randomly occur from time to time and from place to place and, therefore, are unpredictable. Since, the DC voltage generated by the power supply is utilized in particular to supply power to the solenoids used to control game features, any variations in the line voltage likewise directly affects the expected operation of these game features. For example, variations in the power may result in the diminution of or a surge in flipper strength which clearly affects the uniformity of play or the "feel" of the machine. Furthermore, if the line voltage falls to low, the flippers in particular may be affected to the point where they can no longer impart enough speed on the ball to allow the ball to reach game features positioned at the upper end of the inclined playfield.

To further complicate this problem, pinball machines which have large numbers of lamps which are frequently switched on and off have an electrical load which fluctuates. This internal fluctuation in the electrical load also functions to vary the power capable of being supplied to the solenoids. In addition, if the pinball machine is connected to a long branch circuit, or if multiple games are connected in a single branch, a variation in the power requirements of any of the other devices on the line also produces additional fluctuations in the line voltage which affects the machine.

Currently, in an attempt to solve this problem and compensate for any losses in line voltage, pinball manufacturers employ solenoids which are designed to have supplied thereto more current than is required to operate under normal conditions whereby normal operation is possible during conditions of low line voltage. However, this overdesign has been seen to accelerate solenoid wear especially during those instances where line voltage surges above nominal. A further solution was proposed in U.S. Pat. No. 4,209,826 to Priegnitz which sought to regulate power through the use of a high frequency switching power supply which supplied regulated DC voltages to every feature of an entire game. Unfortunately, this system suffers from the main disadvantage of being very costly to implement. As such, an unfulfilled need exists for a pinball machine having the ability to compensate for variations in the line voltage which system can be implemented at a minimal cost.

As a result of this existing need, it is an object of the present invention to provide a power system which can regulate power to selected play features.

It is a further object of the present invention to provide a power system which regulates power synchronously with the AC line cycle.

It is yet another object of the present invention to provide a power system which will allow pinball machines to be shipped with solenoids chosen for the optimum power thereby reducing wear which would otherwise result from overdesign.

It is still a further object of the present invention to provide a power system which will maintain the consistency or "feel" of the game despite line voltage variations.

It is still another object of this invention to provide a power system which will accommodate the use of an unfiltered DC power supply.

SUMMARY OF THE INVENTION

In accordance with the present invention, a pinball machine is provided and generally includes a power supply for supplying unfiltered, unregulated DC voltage, a solenoid for activating a play feature device, a microprocessor for controlling game play activities, a clock associated with the microprocessor for supplying a first interrupt signal thereto, a memory device associated with the microprocessor having stored therein a plurality of duty cycle settings, each of the duty cycle settings comprising a predetermined pattern of ON and OFF states, a voltage detection circuit linked to the microprocessor and connected to the power supply for providing to the microprocessor a voltage value indicative of the level of the DC voltage, wherein the microprocessor utilizes the voltage value to select one of the plurality of duty cycle settings, and a driver, responsive to the microprocessor, connecting the power supply to the solenoid for controlling the flow of current thereto based upon a corresponding one of the states of the predetermined pattern of the select one of the plurality of duty cycle settings as determined by the first interrupt signal.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF TEE DRAWINGS

For a better understanding of the invention, reference may be had to the preferred embodiment shown in the following drawings in which.

DETAILED DESCRIPTION

While the invention can be used in conjunction with any type of movable play feature found in a coin operated game it will be described hereinafter in the context of a flipper mechanism as found in a pinball machine as the preferred embodiment thereof.

Figure 1:
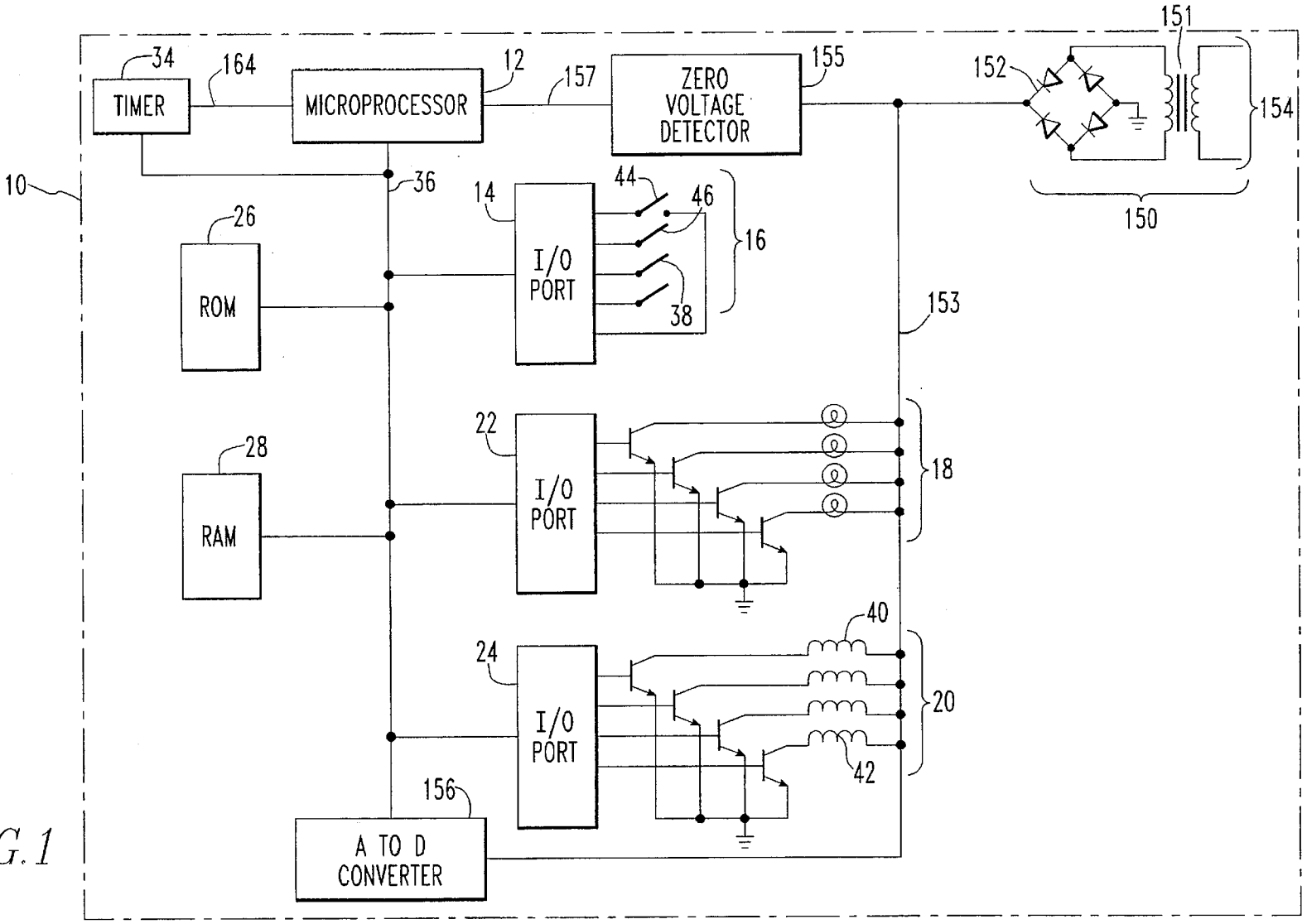
FIG. 1 illustrates in block diagram form a pinball machine in which the subject invention resides.

Referring now to the figures, wherein like reference numerals refer to like elements, there is shown in block diagram format in FIG. 1 a pinball machine 10. As will be understood by those skilled in the art, the pinball machine 10 generally comprises a microprocessor 12 for executing operating instructions based on information received via an I/O port 14 from switches 16 associated with the game cabinet. The microprocessor 12 utilizes this information to control various lamps 18, solenoids 20, and like devices via I/O ports/drivers 22,24.

Software instructions for carrying out the play of the game are typically stored in a ROM 26 while temporary information relating to game conditions are stored in a RAM 28. Information relating to specific operating parameters such as the price of the game, the scores required for free games, and the like are preferably stored in a non-volatile memory or NVRAM 30 whereby such information may be maintained during loss of power. In addition, an alphanumeric display 32 is utilized to provide, among other things, animation or information to a player, and information to the operator during setup, diagnostics, and/or retrieval of game play statistics. The microprocessor 12 accesses and/or controls all of these various components via a bus 36.

To supply power for operating the various described circuits, the pinball machine 10 further comprises an unregulated power supply 150 which, in turn, comprises a transformer 151 and a bridge rectifier or the like 152. The power supply 150 is used to provide unregulated, full wave rectified, unfiltered DC voltage to the various components via supply lead 153. As this voltage is unregulated its peak and average values will vary in direct proportion to the AC line voltage at the power line input 154. Further connected to the supply lead 153 is a zero detect circuit 155 and an A/D converter 156. Both the zero detect circuit 155 and the A/D converter circuit 156 are connected to the microprocessor 12 via an interrupt line 154 and bus 36 respectively. The zero detect circuit 155 is utilized to determine when the rectified voltage at supply lead 153 is near zero and the A/D converter 156 is utilized to supply the microprocessor with a reading of the voltage on the supply lead 153 for purposes which will be discussed in greater detail hereinafter.

As is typical, the game software in ROM 26 includes various interrupt routines which may be executed periodically when triggered by, for example, a timer/clock 34 or the zero detect circuit 155 (periodic interrupt routines). Other interrupt routines may be executed directly in response to other predetermined interrupt conditions (conditional interrupt routines). In response to an interrupt condition, the interruption of the main program flow and the execution of the appropriate interrupt routines occurs. Once completed, control is again returned to the main program whereafter the main program continues to execute from the point at which it was interrupted. The various interrupt routines may be used to count multiple interrupts for timing longer intervals in response to clock generated interrupts, to transfer scores or other data to the displays, or for performing other similar activities. In accordance with the present invention, the interrupt routines may also be used to regulate the current supplied to the flipper coils and, therefore, the power of the flippers. Preferably, this is accomplished by means of pulse width modulation.

Figure 2:
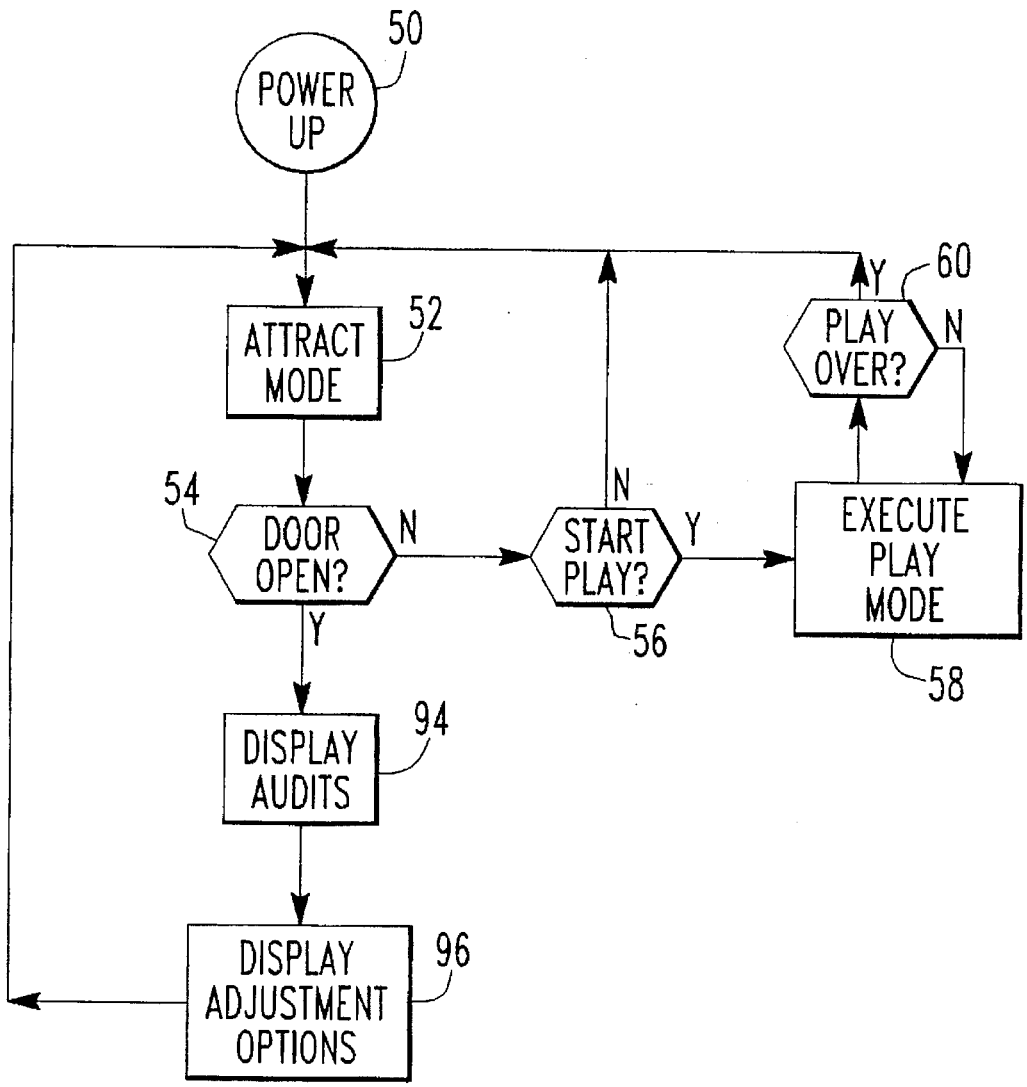
FIG. 2 illustrates the general operation of the pinball machine shown in FIG. 1.

With reference to FIGS. 1 and 2, operation of the game is generally described. From power up (flow chart element 50) the game enters the attract mode (52) which preferably causes various images to be displayed on the alphanumeric display 32 and various lamps 18 to become illuminated for the purpose of drawing a player's attention to the machine. During the attract mode (52) a door switch 38 is constantly monitored (54) to determine whether the machine is player ready or operator ready. If the door switch 38 indicates that the machine is in player mode (i.e. the door switch is "open") a coin detect switch and start switch (not shown) are also repeatedly tested (56) to determine if the machine should start game play (58). Since the specific actions for starting game play in response to the activation of the coin detecting switch, the start switch, and other associated switches are well understood in the art they will not be described in further detail herein. If, however, the door switch 38 indicates the machine is in operator mode (i.e. the service door of the game is open and the associated switch is in the "closed" position) the machine allows various operator related activates to be performed.

Once the machine enters game play (58) the instructions related to game play are executed until it is determined that game play is over (60). Upon the end of game play the machine returns to the attract mode (52). As discussed previously, during the execution of the game play instructions, the clock 34 is used to generate a clock interrupt signal on line 164 for causing the microprocessor 12 to execute a periodic clock interrupt routine. Similarly, the zero detect circuit 155 is used to generate a zero detect interrupt signal on line 154 for causing the microprocessor to execute a periodic zero detect interrupt routine.

Figure 3:
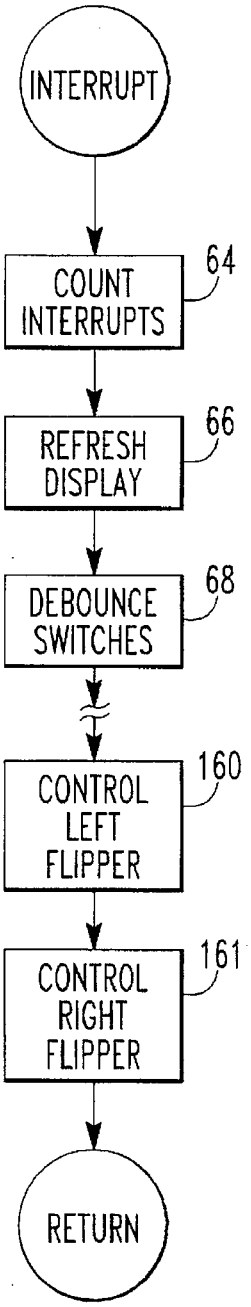
FIG. 3 illustrates a periodic clock interrupt routine which interrupts the general operation of the pinball machine shown in FIG. 1 for performing operation specific subfunctions.
Figures 4, 5:
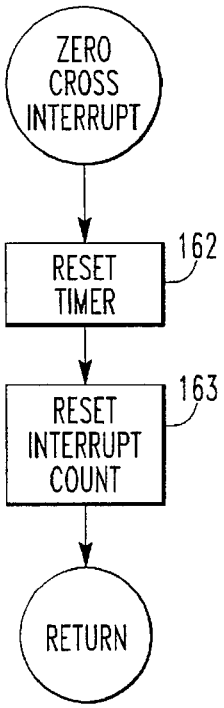
FIG. 4 illustrates in tabular form the duty cycle setting patterns used in conjunction with the subfunction illustrated in FIG. 3A.
FIG. 5 illustrates a periodic zero voltage detect routine which interrupts the general operation of the pinball machine shown in FIG. 1 for performing operation specific subfunctions.

To generate the zero detect interrupt, the zero detect circuit 155 monitors the supply lead 153 and determines when the rectified voltage is approximately zero. The rectified voltage from a 60 Hz line should experience near zero voltage approximately every 8 milliseconds or once every half-cycle. Meanwhile, the clock 34 is used to generate a clock interrupt signal which, preferably, is selected to be 1/32th of the period of the unfiltered DC waveform so that thirty two clock interrupts will be supplied to the micro processor within that period. To accomplish this, the clock 34 selected should be able to generate an interrupt signal at a rate of approximately 0.25 milliseconds. The periodic interrupt routines which are caused to be executed by these interrupts are generally shown in FIGS. 3 and 5. These routines may be considered to be independent programs except that data in RAM 28 and NVRAM 30 are shared with the main program.

The periodic clock interrupt routine illustrated in FIG. 3 comprises, among other subroutines (not shown), a subroutine (64) which counts multiple interrupts for timing longer intervals, a subroutine (66) which transfers scores or other data to the display, and a subroutine (68) which is used for switch debounce. Again, since these subroutines are well known in the art, they will not be described in greater detail herein. In addition, the periodic interrupt routine also includes subroutines (70 and 72) which are utilized to control left and right flippers via corresponding flipper coils 40 and 42. These identical subroutines are more clearly illustrated in FIG. 3*a*.

As noted, with each execution of the periodic clock interrupt routine the left and right flipper control subroutines (70 and 72) are also executed. These subroutines first examine the state (74) of the appropriate flipper switch 44 or 46. If the switch is open (i.e. it is not desired to activate the corresponding flipper), the corresponding flipper is turned off (76) with the microprocessor 28 directing the I/O driver 24 to prevent or interrupt current flow to the corresponding flipper coils. If the switch is closed (i.e. it is desired to activate the corresponding flipper), the flipper duty cycle setting is first retrieved (78).

The various flipper duty cycle settings are located in ROM 26 where each of the plurality of duty cycle settings comprises a pattern of states (ON and OFF—i.e. whether or not current is to be supplied to the flipper coils) over a predetermined number of successive clock interrupt counts. In the preferred embodiment, illustrated as a table in FIG. 4, duty cycle settings ranging from 75% to 100%, with step increases therebetween, are available each having an ON and OFF state pattern defined over a count of 16 interrupts. Since the clock 34 in the preferred embodiment will generate 32 interrupts per cycle period it is contemplated that the selected pattern will be repeated twice over each period. In the illustrated embodiment, for example, the duty cycle setting corresponding to 100% has a pattern of 16 successive ON states or one for each of the 16 clock interrupt counts while the duty cycle setting corresponding to 75% has a pattern of 3 successive ON states followed by an OFF state over the count of 16 interrupts.

Returning to FIG. 3*a*, the retrieval of the flipper duty cycle setting (78) is first performed by reading the power supply voltage from the line 153 through the A/D converter 156 which voltage is compared to the nominal voltage and, thereafter, determining the appropriate duty cycle pointer to utilize. In the preferred embodiment, since it is desired that the solenoid be designed to operate at a duty cycle of approximately 87% (to compensate for the plus or minus 15% swings in the line voltage), if the difference between the read power supply voltage and the nominal line voltage is within 3% the duty cycle pointer will default to point to the corresponding 87% duty cycle column address in the table. If, however, the power supply voltage as compared to the nominal voltage varies outside of acceptable limits, the duty cycle pointer will be correspondingly adjusted and point to a duty cycle setting which will adjust the overall average current/voltage supplied to the solenoid to maintain the approximate appearance or feel of a solenoid operating at an average of 87% of nominal voltage over the cycle period. For example, if the read voltage differs by between 3% and 9% of the nominal voltage (representing an increase in voltage) the duty cycle pointer will point to a duty cycle representing 81% whereby less average voltage will be supplied to the solenoid for compensation purposes. Similarly, if the read voltage is less than the nominal voltage by between 9% and 3% the average voltage supplied to the solenoid should be increased to 94% and the pointer accordingly adjusted. As seen, by selecting the appropriate duty cycle an increase and/or a decrease in line voltage can effectively hidden. It is understood that this process of selecting the appropriate duty cycle may be performed at varying times and need not be performed with each iteration of the subroutine as disclosed herein. Furthermore, it is emphasized that the duty cycle settings disclosed herein for various line voltage values are illustrative only and are not intended to be limiting.

A second offset pointer is then read (80) from RAM 28 which represents the current clock interrupt count. These two pointer are utilized to retrieve (82) from the table the state the corresponding solenoid is to be placed in. This may be accomplished by, for example, adding the two pointers to determine the specific address within the table where the state to be retrieved is located. Once the state has been retrieved (82), the microprocessor 28 then determines (84) whether or not current/voltage is to be supplied to the flipper coils via the I/O drivers 24. Specifically, if the state is OFF the microprocessor 28 directs the I/O driver 24 to prevent or interrupt current flow to the corresponding flipper coils (76) and if the state is ON the microprocessor 28 directs the I/O driver 24 to allow current to flow to the corresponding flipper coils (86). The supply or non-supply of current to the corresponding flipper coils to place the flipper coils in the desired state continues until the timed interrupt routine is again executed. Of course, when play ends the flippers are deactivated.

Finally, before exiting the subroutine, the clock interrupt count/pointer is incremented (88) and a test (90) is performed to ensure that the end of the pattern has not been surpassed. Specifically, if the pointer was at the maximum count, count 15 of the illustrated table column corresponding to the power setting selected, the incrementing process causes the pointer corresponding to the clock interrupt count to be next set to its initial value (92), the start of the table column at count 0. This ensures that the pointer remains in the appropriate power setting and also allows the pattern to be repeated over the full cycle of 32 counts per period.

As disclosed, it should be apparent that the state of the driver 24 follows the pattern of the states in the power setting selected. As a result, the average value of the current/voltage being supplied to the flipper coils can be varied from a maximum of continuously ON current (100%) to some desired percentage thereof. It is to be noted that the short time between interrupts prevents the solenoid from materially changing its position when the pattern transitions between ON and OFF states and, therefore, no material amount of "fluttering" of the plunger should be experienced. This routine may be repeated for as many flippers or other solenoid controlled devices as are located on the machine.

The zero detect interrupt routine, illustrated in FIG. 5, is initiated upon the detection of a near zero voltage level on line 153. Upon execution, the subroutine directs the microprocessor 12 to reset the clock 34 via bus 36 (162) and thereafter resets the interrupt count (163) whereby the interrupt count pointer is again set to point to the first state located in the duty cycle setting selected. This routine ensures that the pulse sequence is synchronized to the period of the unfiltered DC power waveform whereby each period results in a repeatable and, therefore, essentially constant average current being provided to the solenoid.

Returning to FIG. 2, when the service door of the machine is determined to be open (54), this typically signals that the operator wishes to readout game data or make game adjustments. Therefore, it is desirable to provide to the operator via the alphanumeric display 32 the audit information (94) and available game adjustment options (96). Typically, the alphanumeric display instructs the operator which switches (i.e. left/right flipper button, start button, etc.) to press to obtain readouts and/or to effect changes in the game setup.

Figure 3A:
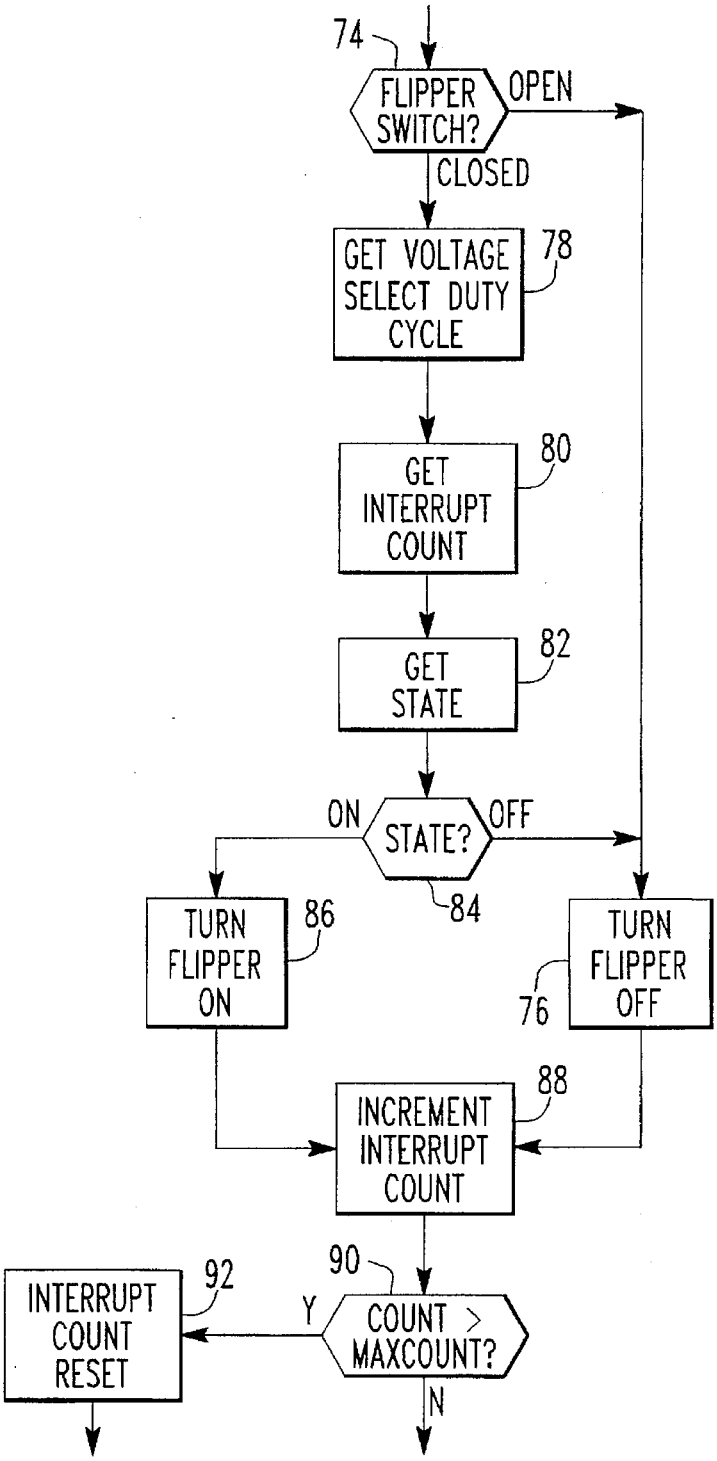
FIG. 3A illustrates the specific subfunction related to the control of a flipper mechanism residing in the pinball machine of FIG. 1.
Figure 6:
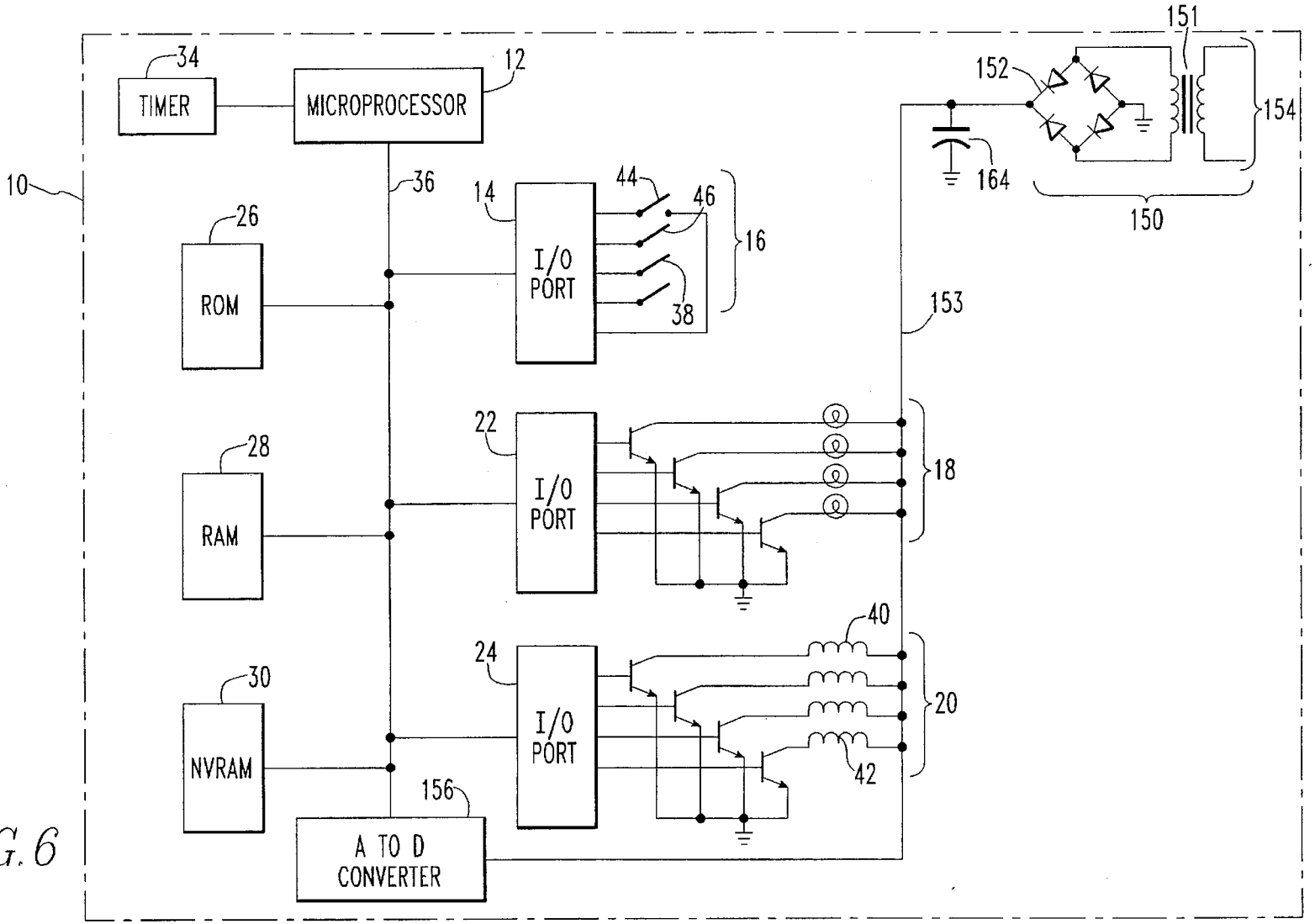
FIG. 6 illustrates an alternative embodiment of the present invention.

Turning to FIG. 6, there is illustrated an alternative embodiment further comprising a filter capacitor 164 which is connected to the power supply lead 153. Capacitor 164 is preferred to be of sufficient capacitance to provide a filtered, continuous DC voltage at supply lead 153 under the maximum current load of all solenoids which may be expected to be activated simultaneously. The operation of this alternate embodiment follows that of the previously described embodiment except that the DC voltage as supply lead 153 is filtered and, therefore, does not fluctuate with the AC line cycle. As such, only the clock interrupt routine of FIGS. 3 and 3*a* are used and there is no requirement for the zero voltage detector and, accordingly, there is no process for synchronizing the timer 34 through reset.

While specific embodiments and objectives of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

I claim:

1. A pinball machine, comprising:

a power supply for supplying unfiltered, unregulated DC voltage;

a solenoid for activating a play feature device;

a microprocessor for controlling game play activities;

a clock associated with said microprocessor for supplying a first interrupt signal thereto;

a memory device associated with said microprocessor having stored therein a plurality of duty cycle settings, each of said duty cycle settings comprising a predetermined pattern of ON and OFF states;

a voltage detection circuit linked to said microprocessor and connected to said power supply for providing to said microprocessor a voltage value indicative of the level of said DC voltage, wherein said microprocessor utilizes said voltage value to select one of said plurality of duty cycle settings;

a driver, responsive to said microprocessor, connecting said power supply to said solenoid for controlling the flow of current thereto based upon a corresponding one of said states of said predetermined pattern of said select one of said plurality of duty cycle settings as determined by said first interrupt signal.

2. The pinball machine as recited in claim 1, further comprising a zero-detect circuit linked to said power supply for providing a second interrupt signal to said microprocessor in response to said DC voltage attaining a level near zero, said microprocessor utilizing said second interrupt signal to reset said clock.

3. The pinball machine as recited in claim 2, wherein said voltage detection circuit comprises an A/D converter.

4. The pinball machine as recited in claim 2, wherein said first interrupt signal is generated at a frequency greater than that in which said second interrupt signal is generated.

5. The pinball machine as recited in claim 4, wherein said second interrupt signal is generated at a rate determined by the frequency of an AC line to which said power supply is linked.

6. The pinball machine as recited in claim 1, further comprising a filter connected to said power supply for filtering said DC voltage.

7. The pinball machine as recited in claim 6, wherein said filter comprises a capacitor.

8. The pinball machine as recited in claim 1, wherein said voltage detection circuit comprises an A/D converter.

9. A pinball machine, comprising:

a power supply for supplying unfiltered, unregulated DC voltage;

a solenoid for activating a pinball flipper mechanism;

a microprocessor for controlling game play activities;

a clock associated with said microprocessor for supplying a first interrupt signal thereto;

a memory device associated with said microprocessor having stored therein a plurality of duty cycle settings, each of said duty cycle settings comprising a predetermined pattern of ON and OFF states;

a voltage detection circuit linked to said microprocessor and connected to said power supply for providing to said microprocessor a voltage value indicative of the level of said DC voltage, wherein said microprocessor utilizes said voltage value to select one of said plurality of duty cycle settings;

a zero-detect circuit linked to said power supply for providing a second interrupt signal to said microprocessor in response to said DC voltage attaining a level near zero, said microprocessor utilizing said second interrupt signal to reset said clock; and a driver, responsive to said microprocessor, connecting said power supply to said solenoid for controlling the flow of current thereto based upon a corresponding one of said states of said predetermined pattern of said select one of said plurality of duty cycle settings as determined by said first interrupt signal.

10. The pinball machine as recited in claim 9, wherein said voltage detection circuit comprises an A/D converter.

11. The pinball machine as recited in claim 9, wherein said first interrupt signal is generated at a frequency greater than that in which said second interrupt signal is generated.

12. The pinball machine as recited in claim 11, wherein said second interrupt signal is generated at a rate determined by the frequency of an AC line to which said power supply is linked.

13. A method for controlling the operation of a solenoid controlled pinball play feature, comprising the steps of:

issuing a command to cause the operation of said play feature during the course of pinball in response to a predetermined play condition;

monitoring the voltage level of a DC voltage power supply used to supply current to said solenoid;

selecting one of a plurality of duty cycle settings stored in a memory device based upon said monitored voltage level;

supplying current to said solenoid in response to said command based upon said selected one of said plurality of duty cycle settings.

14. The method as recited in claim 13, wherein each of said duty cycle settings comprises a predetermined pattern of ON and OFF states.

15. The method as recited in claim 14, further comprising the step of providing a periodic interrupt to said microprocessor for causing said microprocessor to issue said command.

16. The method as recited in claim 15, further comprising the step of sequencing through said states of said selected one of said plurality of duty cycle setting and supplying current to said solenoid based upon a corresponding state in said sequence.

17. The method as recited in claim 16, further comprising the steps of detecting when said DC voltage approaches zero and synchronizing said periodic interrupt thereto.

* * * * *